US005147229A

United States Patent [19]

Nestor

[11] Patent Number: 5,147,229

[45] Date of Patent: Sep. 15, 1992

[54] HIGH CURRENT ELECTRICAL CONNECTOR

[75] Inventor: Charles R. Nestor, Niles, Ohio

[73] Assignee: General Motors Corporation, Detroit, Mich.

[21] Appl. No.: 448,387

[22] Filed: Dec. 11, 1989

[51] Int. Cl.[5] ..... H01R 11/22

[52] U.S. Cl. ..... 439/843; 439/851

[58] Field of Search ..... 439/843, 851, 852, 854, 439/855, 827

[56] References Cited

U.S. PATENT DOCUMENTS

| | | | |
|---|---|---|---|
| 3,449,709 | 6/1969 | Veteran | 339/258 |
| 3,453,587 | 7/1969 | Neidecker | 339/256 |
| 3,956,607 | 5/1976 | Wijnandsbergen | 439/843 |
| 4,039,238 | 8/1977 | Johnson, Jr. et al. | 339/95 |
| 4,083,622 | 4/1978 | Neidecker | 439/843 |
| 4,120,557 | 10/1978 | Horrocks | 339/252 |
| 4,128,293 | 12/1978 | Paoli | 439/843 |
| 4,657,335 | 4/1987 | Koch et al. | 339/256 |
| 4,720,157 | 1/1988 | Nestor et al. | 339/255 |

FOREIGN PATENT DOCUMENTS

| | | |
|---|---|---|
| 637065 | 10/1936 | Fed. Rep. of Germany . |
| 1361891 | 4/1964 | France . |

*Primary Examiner*—Larry I. Schwartz
*Assistant Examiner*—Hien D. Vu
*Attorney, Agent, or Firm*—F. J. Fodale

[57] ABSTRACT

A high current electrical socket connector has a resilient metal contact strip which is rolled into a split tube and fitted inside a barrel terminal. The contact strip has a plurality of vanes which are shaped to resiliently support and retain the contact strip in the barrel terminal while providing low pressure, large contact areas for engaging the cylindrical contact surface of a mating electrical plug connector.

8 Claims, 2 Drawing Sheets

HIGH CURRENT ELECTRICAL CONNECTOR

BACKGROUND OF THE INVENTION

This invention relates generally to electrical connectors and more specifically to high current electrical connectors which use a resilient metal contact strip which provides a circumferential array of mechanically connected electrical contacts for transmitting large amounts of current from one cylindrical contact surface to another such as the inner surface of a barrel terminal to the outer surface of a pin terminal.

Electrical connectors of this type are already known from U.S. Pat. No. 3,453,587 granted to Rudolph Neidecker Jul. 1, 1969 which discloses an electrical connector which uses a metal strip 6 to transmit current from a jack or sleeve 1 or 1*a* to a mating plug 2. The metal strip 6 is slitted transversely at 7 to form a multiplicity of tongues 5 which incline at an angle of approximately 45 degrees at their central portions. The strip 6 is fitted into the sleeve 1 so as to be held by its own resilience against the inner periphery of the sleeve. With this arrangement the outer edges of the tongues 5 bear on the inner periphery of the sleeve 1 while the inner edges of the tongues 5 are positioned to engage the plug 2 when it is inserted into the sleeve. The tongues 5 twist resiliently when the plug 2 is inserted so that the inner and outer edges of the tongues 5 are biased into engagement with the respective peripheries of the plug and sleeve. A drawback of this electrical connector is that the high pressure, low contact area at the inner edges of the contact tongues 5 is sensitive to tolerance variation and subject to considerable wear after repeated disconnections and reconnections of the plug.

In the U.S. Pat. No. 4,039,238 granted to Glenn W. Johnson, Jr. et al Aug. 2, 1977 modifications for improving the electrical contact of the Neidecker contact strip with the plug or pin are proposed. More specifically, the Johnson et al connector uses an elongate contact strip 10 which has expanses 16 which are twisted about transverse axes 18 which are closer to one edge. Thus the inward finger parts 16*a* for engaging the pin 22 are longer and have a lower spring rate which reduces the sensitivity to tolerance variation according to the Johnson et al patent. This modification however does little if anything with respect to the problem of wear which occurs with repeated disconnections and reconnections of the pin 22.

In the U.S. Pat. No. 4,120,557 granted to Raymond G. Horrocks Oct. 17, 1978, a modification for improving field replacement of the electrical contact strip used in the Neidecker connector is proposed. More specifically, the electrical contact strip 10 of the Horrocks connector comprises a pair of closed annular rail portions 14 between which extend a cylindrical tubular array of louvers 16. Each louver has a bottom portion 18 with slanting portions 20 on each side. The slanting portions 20 are deflected upon engagement by one interconnection surface 28 or 30 which in turn forms protruding ridges 34 on the bottom portion 18 engaging the other interconnection surface. The contact strip 10 may be mounted in the bore of a housing with the portions 20 slanting inwardly as shown in FIGS. 8 and 9 or on a male plug with the portions 20 slanting outwardly as shown in FIG. 10. This modification likewise does little if anything with respect to the problem of wear because the edges of the slanting portions 20 engage the part which is repeatedly disconnected and reconnected.

Moreover, this modification has considerable sensitivity to tolerance variation because the annular rail portions 14 are closed which also requires a two piece housing or male plug for assembly.

SUMMARY OF THE INVENTION

The object of this invention is to provide an improved high current electrical connector of the type which use a resilient metal contact strip to provide a circumferential array of mechanically connected electrical contacts for transmitting large amounts of current from one cylindrical contact surface to another.

One feature of the invention is that the electrical connector has a resilient metal contact strip which is formed with a plurality of vanes which are shaped to resiliently support and retain the contact strip on one cylindrical contact surface while providing low pressure, large contact areas for engaging another cylindrical contact surface.

Another feature of the invention is that the electrical connector has a resilient metal contact strip which is formed with a plurality of vanes which have small central tabs on one edge which are bent to support the contact strip on the cylindrical contact surface of an electrical connector at high pressure, small contact areas of engagement so that there is little, if any relative movement and wear during engagement and disengagement of the mating electrical connector.

Another feature of the invention is the electrical connector has a resilient contact strip which is formed with a plurality of vanes which are shaped so that substantially the full length of each vane provides a low pressure, large contact area which is engaged by the contact surface of the mating connector to reduce wear resulting from frequent disconnection and reconnection of the mating connector.

Another feature of the invention is that electrical connector has a resilient metal contact strip which is formed into a split ring which floats on the cylindrical contact surface of the connector and adjusts circumferentially when the mating connector is engaged so that the electrical connector is characterized by low engagement force requirements.

Still yet another feature of the invention is that the electrical connector has a resilient contact strip which has an interference fit with the cylindrical contact surface of the connector which is sufficient to retain the resilient contact strip in place when it adjusts upon engagement of the mating connector.

Other objects and features of the invention will become apparent to those skilled in the art as disclosure is made in the following detailed description of a preferred embodiment of the invention which sets forth the best mode of the invention contemplated by the inventors and which is illustrated in the accompanying sheets of drawing.

DETAILED DESCRIPTION OF THE PREFERRED EMBODIMENT

Figure 1:
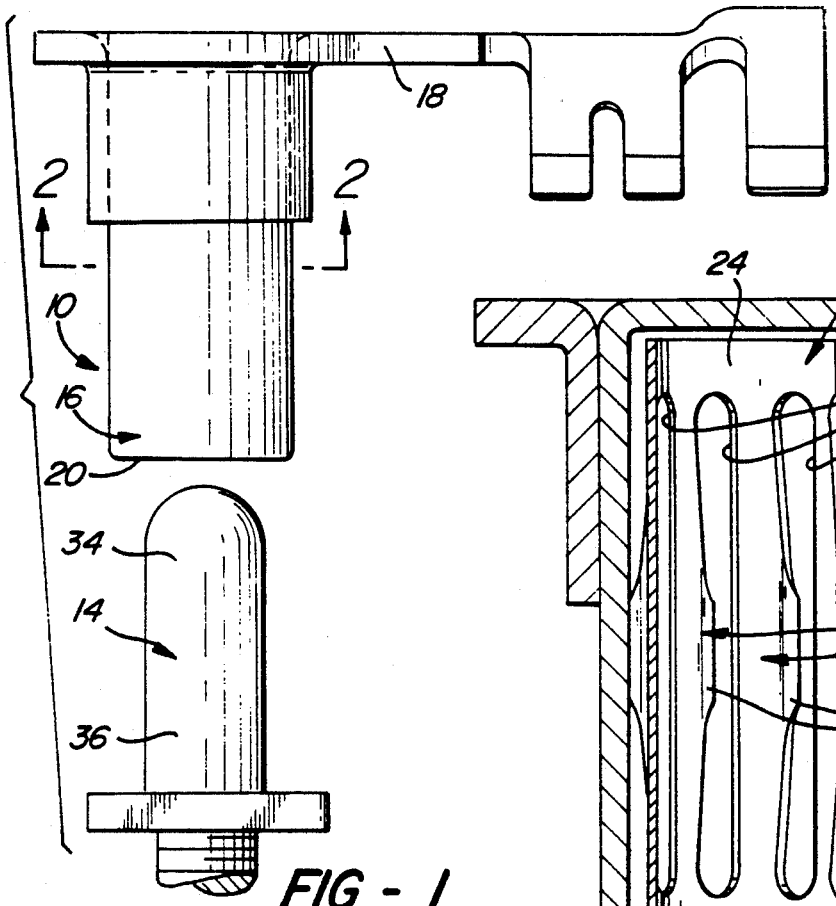
FIG. 1 is a side view of a high current electrical connector in accordance with the invention juxtaposed with a mating electrical connector.

Referring now to the drawing, the invention is illustrated in connection with a high current electrical socket connector 10 which has a resilient metal contact strip 12 which provides a circumferential array of mechanically connected contacts for transmitting large amounts of current from a cylindrical contact surface of the socket connector 10 to a cylindrical contact surface of a mating electrical plug connector 14.

The electrical socket connector 10 of the illustrative embodiment is in the form of a cable terminal which comprises a barrel terminal 16 which is force fit in a flanged hole of a ring terminal 18 which is adapted for crimping onto the end of an electric cable (not shown). The formed barrel 16 has a closed end and an open end. The open end has a circumferential lip 20 which extends inwardly of the cylindrical contact surface 22 inside the formed barrel 16.

Figure 5:
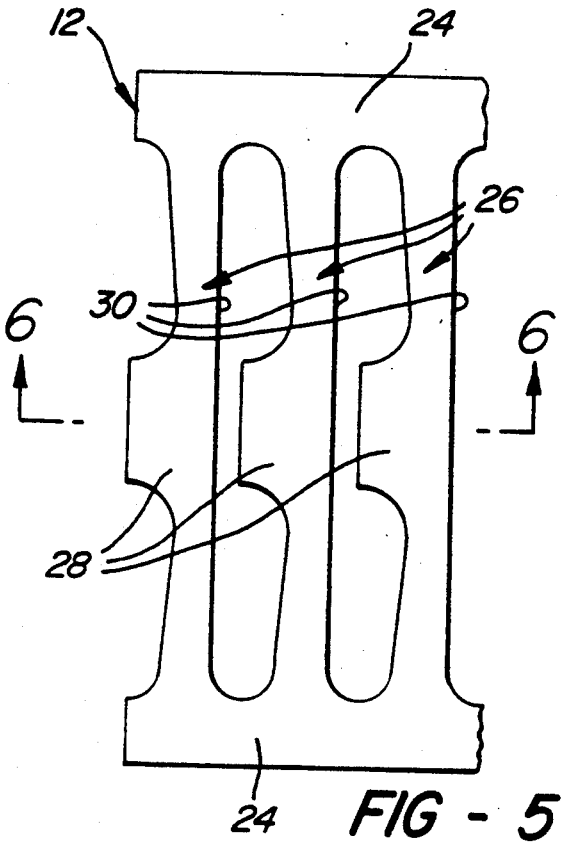
FIG. 5 is a fragmentary plan view of a sheet metal blank for making a resilient metal contact strip of the high current electrical connector which is shown in FIGS. 1, 2, 3 and 4.
Figure 6:
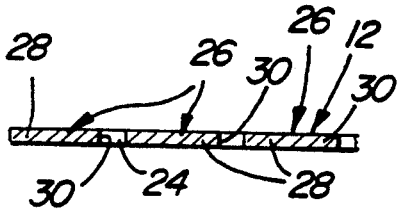
FIG. 6 is a section take substantially along the line 6—6 of FIG. 5 looking in the direction of the arrows.

The resilient metal contact strip 12 is made by stamping a series of windows in a resilient sheet metal strip of beryllium copper of other suitable conductor material to form end bands 24 interconnected by a plurality of vanes 26. The stamped windows are shaped so that each of the vanes 26 has a small central tab 28 at one edge and an opposite edge 30 which is generally straight and perpendicular to the length of the end bands 24 as shown in FIGS. 5 and 6. The width of each vane 26 decreases gradually toward the central tab 28. Each entire vane 26 including its central tab 28 is planar or straight for its full extension between the end bands 24 as shown in FIG. 6.

Figure 3:
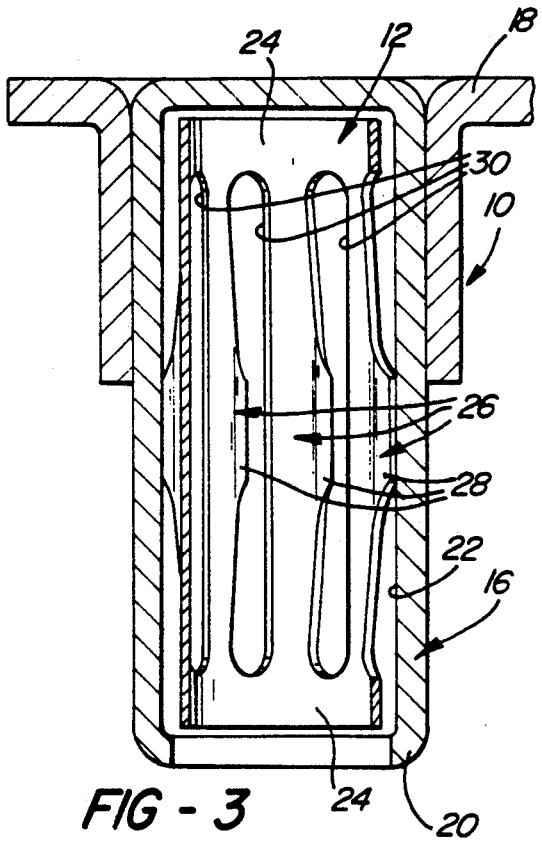
FIG. 3 is a section taken substantially along the line 3—3 of FIG. 2 looking in the direction of the arrows.
Figure 2:
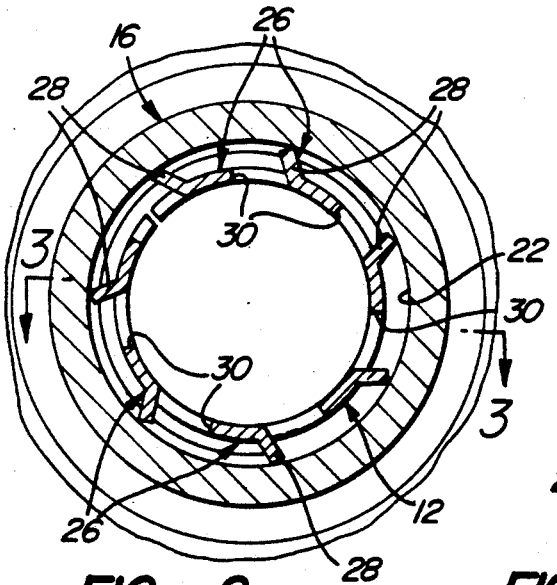
FIG. 2 is a section taken substantially along the line 2—2 of FIG. 1 looking in the direction of the arrows.
Figure 4:
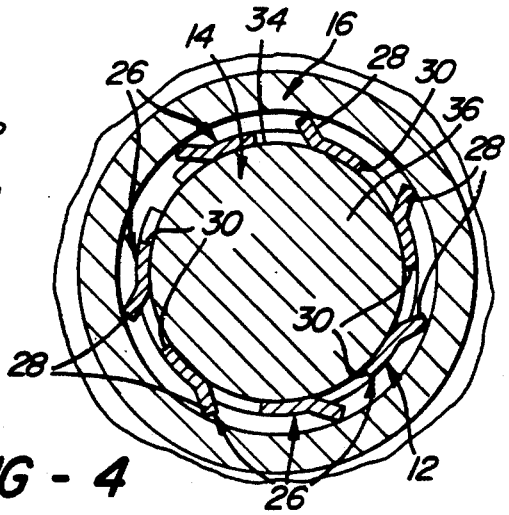
FIG. 4 is a view similar to FIG. 2 but showing the high current electrical connector engaged with the mating electrical connector.
Figure 7:
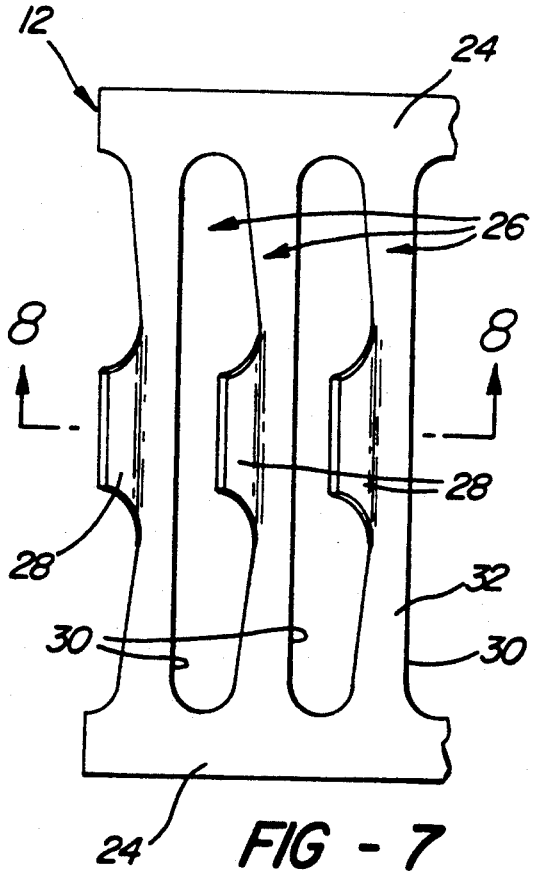
FIG. 7 is a fragmentary plan view of the sheet metal blank of FIGS. 5 and 6 after further processing.
Figure 8:
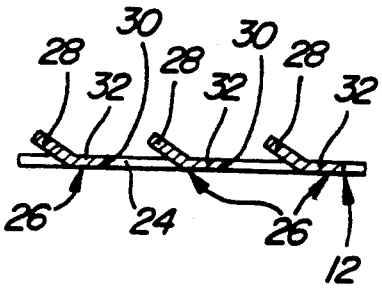
FIG. 8 is a section taken substantially along the line 8—8 of FIG. 7 looking in the direction of the arrows.

The central tabs 28 are then bent at an angle with respect to the portions 32 of the vanes 26 which remain planar or straight for their full extensions between the end bands 24 as shown in FIGS. 7 and 8. The stamped and bent strip 12 is then rolled into a split ring having straight vane portions 32 with the bent integrally connected central tabs 28 extending radially outwardly. This split ring is placed inside the barrel terminal 16 where the central tabs 28 resiliently support and retain the split ring configured contact strip 12 on the inner cylindrical contact surface 22 of the barrel terminal 16 while the straight vane portions 32 provide low pressure, large contact areas for engaging the outer cylindrical contact surface of the mating electrical plug connector 14 as shown in FIGS. 2 and 3.

When the split ring configured contact strip 12 is placed inside the barrel terminal 16, the straight vane portions 32 lie on an inner diameter which is smaller than the diameter of the cylindrical contact surface 34 of the electrical plug connector 14 which is in the form of a pin terminal 36. However, the split ring configured contact strip 12 floats in the barrel terminal 16 by virtue of the resilience of the central tabs 28 and thus the contact strip 12 expands when engaged by the outer cylindrical contact surface 36 as the mating pin terminal 36 is inserted.

The initial interference fit between the edges of the central tabs 28 and the cylindrical contact surface 22 inside the barrel terminal 16 is preferably sufficient to retain the resilient metal contact strip 12 in place upon engagement and disengagement of the mating pin terminal 36.

More specifically, the small central tabs 28 have edges which engage the cylindrical contact surface 22 and support the resilient metal contact strip 12 at high pressure, small contact areas of engagement so that there is little, if any relative movement between the central tabs 28 and the inner cylindrical contact surface 22 of the barrel terminal 16 during engagement and disengagement of the mating pin terminal 36.

When the pin terminal 36 is inserted into the contact strip 12 which is inside the barrel terminal 16, the straight portions 32 of the vanes 26 provide low pressure, large contact areas for engaging the outer cylindrical contact surface of the mating pin terminal 36 which extend for substantially the full length of the vanes 26 between the end bands 24 and even onto the end bands 24 in some instances. Consequently there is little wear due to repeated disconnections and reconnections of the electrical plug connector 14.

We wish it to be understood that we do not desire to be limited to the exact details of construction shown and described, for obvious modifications will occur to a person skilled in the art.

The embodiments of the invention in which an exclusive property or privilege is claimed are defined as follows:

1. A high current electrical connector having a resilient metal contact strip which provides a circumferential array of mechanically connected contacts for transmitting large amounts of current from one cylindrical contact surface to another comprising:

a connector member having a cylindrical contact surface which supports the resilient metal contact strip for engagement by a cylindrical contact surface of a mating connector member, the resilient metal contact strip having end bands and a plurality of vanes which are attached to the end bands at their respective ends and which are shaped to resiliently support and retain the contact strip on the cylindrical contact surface of the connector member while providing low pressure, large contact areas for engaging the cylindrical contact surface of the mating connector member, the plurality of vanes having small central tabs on one edge which are bent at an angle with respect to straight portions of the respective vanes which extend between the end bands, the central tabs supporting the resilient metal contact strip at high pressure, small contact areas of engagement so that there is little, if any relative movement between the tabs and the cylindrical contact surface of the connector member during engagement and disengagement of the mating connector member, and the straight portions of the vanes providing the low pressure, large contact areas for engaging the cylindrical contact surface of the mating connector member.

2. The high current electrical connector as defined in claim 1 wherein the straight portions of the vanes provide low pressure, large contact areas for engaging the cylindrical contact surface of the mating connector member which extend for substantially the full length of the vanes between the end bands.

3. The high current electrical connector as defined in claim 1 wherein the resilient metal contact strip is formed into a split ring which floats on the cylindrical contact surface of the connector member and adjusts circumferentially when the cylindrical contact surface of the mating connector member is engaged.

4. The high current electrical connector as defined in claim 3 wherein the resilient metal contact strip has an interference fit on the cylindrical contact surface of the connector member which is sufficient to retain the resilient metal contact strip in place when it is adjusted upon engagement of the cylindrical contact surface of the mating connector member.

5. A high current electrical socket connector having a resilient metal contact strip which provides a circumferential array of mechanically connected contacts for transmitting large amounts of current from one cylindrical contact surface to another comprising:

a barrel terminal having an inner cylindrical contact surface which supports the resilient metal contact strip for engagement by an outer cylindrical contact surface of a mating pin terminal, the resilient metal contact strip having end bands and a plurality of vanes which are attached to the end bands at their respective ends and which are shaped to resiliently support and retain the contact strip on the inner cylindrical contact surface of the barrel terminal while providing low pressure, large contact areas for engaging the outer cylindrical contact surface of the mating pin terminal, the plurality of vanes having straight portions which extend between the end bands and which provide the low pressure, large contact areas for engaging the outer cylindrical contact surface of the mating pin terminal, and the plurality of vanes having small central tabs on one edge which are bent at an angle with respect to straight portions and which support the resilient metal contact strip at high pressure, small contact areas of engagement so that there is little, if any relative movement between the tabs and the inner cylindrical contact surface of the barrel terminal during engagement and disengagement of the mating pin terminal.

6. The high current electrical connector as defined in claim 5 wherein the straight portions of the vanes provide low pressure, large contact areas for engaging the outer cylindrical contact surface of the mating pin terminal which extend for substantially the full length of the vanes between the end bands.

7. A high current electrical socket connector having a resilient metal contact strip which provides a circumferential array of mechanically connected contacts for transmitting large amounts of current from one cylindrical contact surface to another comprising:

a barrel terminal having an inner cylindrical contact surface which supports the resilient metal contact strip for engagement by an outer cylindrical contact surface of a mating pin terminal, the resilient metal contact strip having end bands and a plurality of vanes which are attached to the end bands at their respective ends and being formed into a split ring which floats in the inner cylindrical contact surface of the barrel terminal and expands when the outer cylindrical contact surface of the mating pin terminal is engaged, the plurality of vanes being shaped to resiliently support and retain the contact strip in the inner cylindrical contact surface of the barrel terminal with an interference which is sufficient to retain the resilient metal contact strip in place upon engagement of the outer cylindrical contact surface of the mating pin terminal, the plurality of vanes having straight portions which extend between the end bands and which provide low pressure, large contact areas for engaging the outer cylindrical contact surfaces of the mating pin terminal, and the plurality of vanes having small central tabs on one edge which are bent at an angle with respect to straight portions and which support the resilient metal contact strip at high pressure, small contact areas of engagement so that there is little, if any relative movement between the tabs and the inner cylindrical contact surface of the barrel terminal during engagement and disengagement of the mating pin terminal.

8. The high current electrical connector as defined in claim 7 wherein the straight portions of the vanes provide low pressure, large contact areas for engaging the outer cylindrical contact surface of the mating pin terminal which extend for substantially the full length of the vanes between the end bands.

* * * * *